US008525061B2

(12) United States Patent
Shea et al.

(10) Patent No.: US 8,525,061 B2
(45) Date of Patent: Sep. 3, 2013

(54) SELF-PRESSURIZED ARC DIVERTER

(75) Inventors: John Joseph Shea, Pittsburgh, PA (US); Paul Kimball Parker, Wexford, PA (US); James Edward Smith, Pittsburgh, PA (US); Michael H. Abrahamsen, Greenwood, SC (US)

(73) Assignee: Eaton Corporation, Cleveland, OH (US)

( * ) Notice: Subject to any disclaimer, the term of this patent is extended or adjusted under 35 U.S.C. 154(b) by 180 days.

(21) Appl. No.: 12/909,003

(22) Filed: Oct. 21, 2010

(65) Prior Publication Data

US 2012/0097642 A1 Apr. 26, 2012

(51) Int. Cl.
*H01H 33/98* (2006.01)

(52) U.S. Cl.
USPC ..... 218/114; 218/52; 218/76; 218/86; 337/140

(58) Field of Classification Search
USPC ..... 337/140; 218/114, 52, 76, 86
See application file for complete search history.

(56) References Cited

U.S. PATENT DOCUMENTS

| | | | | | |
|---|---|---|---|---|---|
| 3,916,259 | A * | 10/1975 | Russell et al. | ..... | 361/41 |
| 4,002,949 | A * | 1/1977 | Westrom | ..... | 361/41 |
| 4,555,602 | A * | 11/1985 | Mennell | ..... | 200/50.21 |
| 5,148,140 | A * | 9/1992 | Goldstein | ..... | 337/158 |
| 5,289,154 | A * | 2/1994 | Davis | ..... | 337/169 |
| 5,435,755 | A * | 7/1995 | Chien et al. | ..... | 439/620.29 |
| 5,920,251 | A * | 7/1999 | Shea | ..... | 337/140 |
| 7,659,804 | B2 * | 2/2010 | Harris et al. | ..... | 337/159 |
| 2010/0194519 | A1 * | 8/2010 | Harris et al. | ..... | 337/227 |
| 2011/0299226 | A1 * | 12/2011 | Milovac et al. | ..... | 361/605 |

* cited by examiner

*Primary Examiner* — Truc Nguyen
(74) *Attorney, Agent, or Firm* — Eckert Seamans Cherin & Mellott, LLC; Kirk D. Houser

(57) ABSTRACT

A self-pressurized arc diverter includes a vessel configured to enclose a fusible member disposed in a conductor and a pressure-activated arc diverter. The pressure-activated arc diverter is configured to provide access to a preferred arc path when actuated by pressure in the vessel caused by an arc that is created when the fusible member opens.

16 Claims, 6 Drawing Sheets

SELF-PRESSURIZED ARC DIVERTER

BACKGROUND

Arc resistant switchgear includes features that mitigate the effects of arcing within an electrical switchgear enclosure. These features are designed to reduce pressure caused by arcing that may result in hot gases escaping the enclosure. In addition, some features function to redirect an arc away from areas that are likely to be accessed by personnel.

SUMMARY

One example embodiment of a self-pressurized arc diverter includes a vessel and a pressure-activated arc diverter. The vessel encloses a fusible member spliced into a conductor. The pressure-activated arc diverter is configured to provide access to a preferred arc path when actuated by pressure in the vessel caused by an arc that is created when the fusible member opens.

In an example embodiment, the vessel includes a cylindrical insulator tube that encloses the fusible link and has end caps through which the conductor passes. The arc diverter includes at least one slot in the cylindrical insulator tube and an insulating cover on the slot. The cover is configured to be dislodged from the slot when the insulator tube becomes pressurized by the arc across the fusible link.

In another example embodiment, the arc diverter includes one or more plugs inserted into holes in one of the end caps of the insulator tube. The one or more plugs are configured to be dislodged from the sealed end when the insulator tube becomes pressurized by the arc across the fusible link.

The preferred arc path may include a ground plane or a conducting plate that routes an arc to an adjacent phase conductor. The preferred arc path may be oriented perpendicular to a flow of current through the conductor to shorten a length of the arc to minimize an amount of pressure created by the arc.

According to another embodiment, a bus assembly includes a bus and a preferred arc path component disposed proximate to the bus that provides a conductive ground path. A fusible link is spliced into the bus that is configured to conduct a rated current of the bus and to vaporize in response to current above the rated current. A vessel encloses the fusible link. A pressure-activated arc diverter provides access to the preferred arc path when actuated by pressure in the vessel caused by an arc that is created when the fusible link opens.

BRIEF DESCRIPTION OF THE DRAWINGS

The accompanying drawings, which are incorporated in and constitute a part of the specification, illustrate various example systems, methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

DETAILED DESCRIPTION

Figure 1:
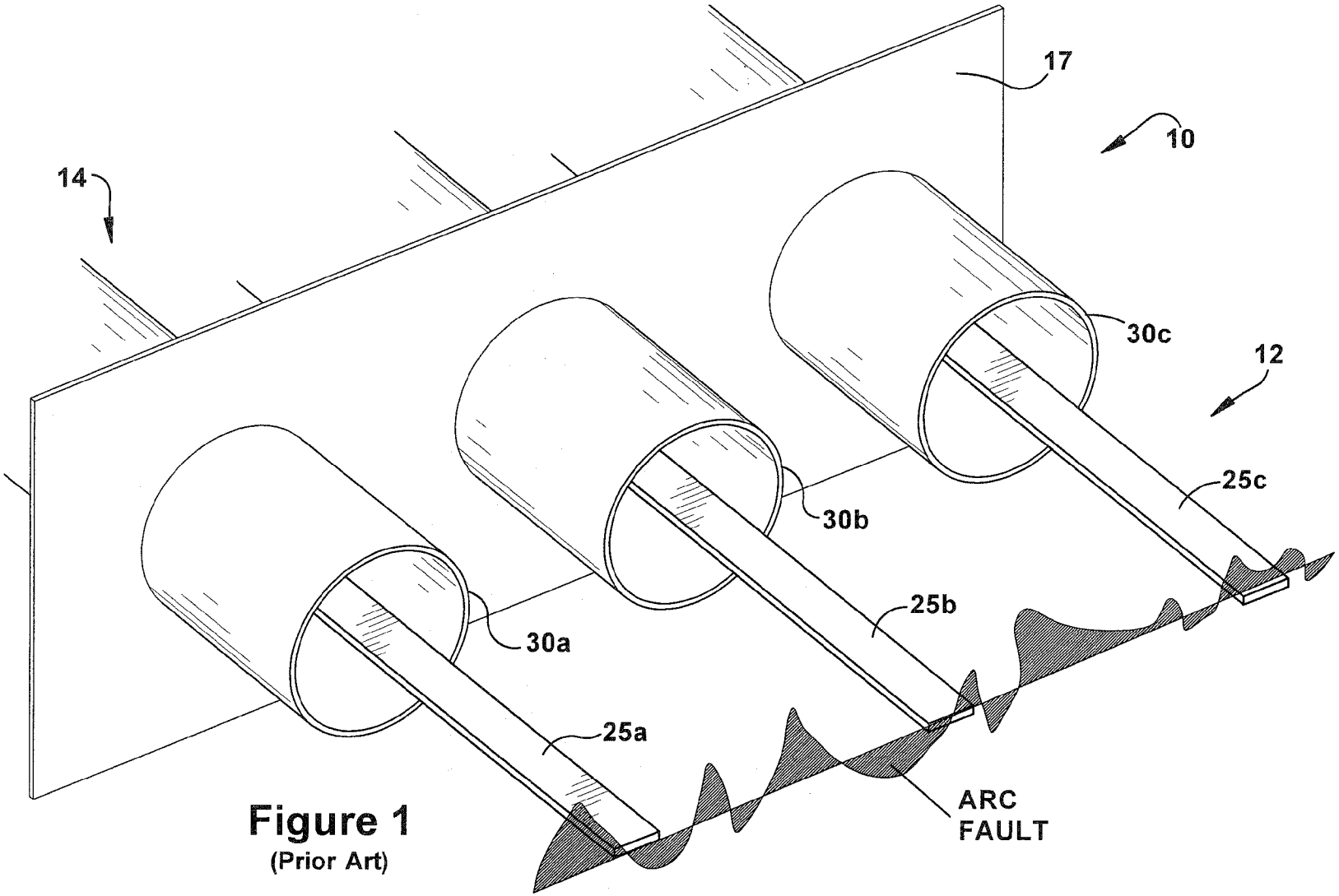
Figure 1 (Prior Art)
FIG. 1 is an isometric view of a prior art electrical enclosure exhibiting an uncontrolled electrical arc.

FIG. 1 shows an interior view of a prior art electrical switchgear enclosure 10. The enclosure 10 is divided by a wall 17 into a main compartment 14 and an auxiliary compartment 12. The main compartment 14 typically houses primary buses (not shown) that are connected to a power source. The auxiliary compartment 12 typically holds transformers or other components that are connected between the power source and the load by way of secondary buses 25*a*, 25*b*, 25*c*. The auxiliary compartment 12 is usually accessed more often by personnel who work on the load-related components. The auxiliary compartment 12 may include vents in exterior walls (not shown) for cooling and ventilation purposes.

Insulator tubes 30*a*, 30*b*, 30*c* surround the connection between the primary buses (not shown) and the secondary buses 25*a*, 25*b*, 25*c* and prevent the buses from shorting to the enclosure wall 17. An uncontrolled arc fault is shown occurring between the secondary buses 25*a*, 25*b*, 25*c*. The uncontrolled arc has significant length, meaning that it will generate significant pressure and tend to cause damage and burn-through of the enclosure, allowing hot gases to escape from the enclosure. In addition, the arc is occurring between electrical phases in the auxiliary enclosure 12, where it may reach an exterior wall or be inadvertently contacted by personnel.

Figure 2:
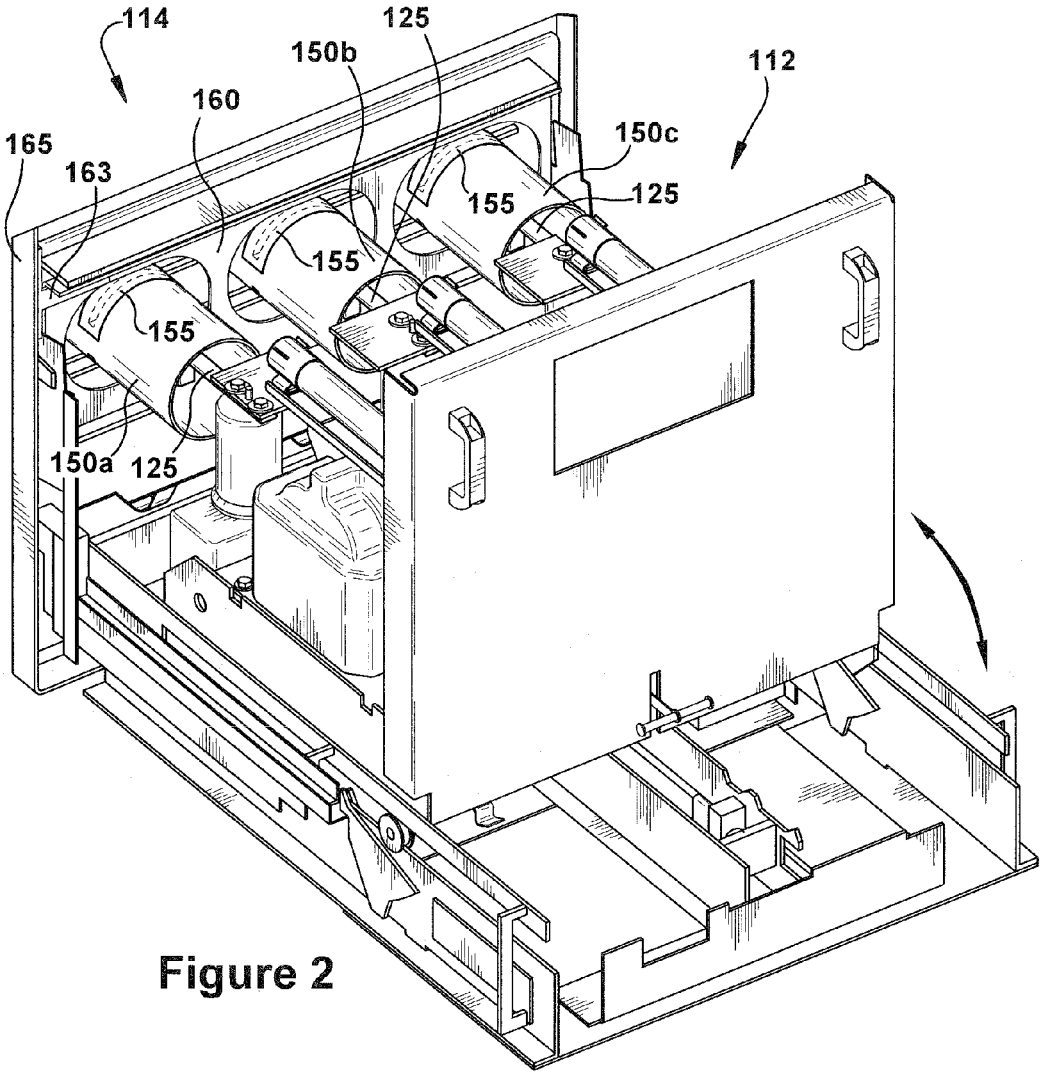
FIG. 2 is an isometric view of an electrical enclosure that includes one example embodiment of self-pressurized arc diverters.

FIG. 2 is an isometric view of an auxiliary compartment 112 that includes one example embodiment of self-pressurized arc diverters 150*a*, 150*b*, 150*c*. The auxiliary compartment 112 is a voltage transformer drawer that houses three transformers, one for each electrical phase. A secondary bus 125 connects each transformer to a corresponding primary bus 120 (not visible in FIG. 2, see FIGS. 3, 3*a*) located in a main compartment 114.

A fusible link (not visible in FIG. 2, see FIGS. 3, 3*a*) is spliced into the primary bus near its connection to the secondary bus 125. The fusible link 132 has a rating in the range of normal current for the load. The normal current draw of the load is typically much lower than the rated current for the circuit breakers used to protect the circuit. When an arc fault occurs the increased current draw may not be sufficient to trip the circuit breaker. However, the fusible link can be selected so that it will vaporize in the presence of an arc fault current. While a fusible link is described herein, any device that vaporizes in response to current draw over its rated value may be utilized.

The self-pressuring arc diverters 150*a*, 150*b*, 150*c* form part of a vessel that encloses the fusible link in the primary bus. The self-pressuring arc diverter 150 is actuated by pressure within the vessel to provide access to a preferred arc path. The pressure is caused by arcing between the primary and secondary conductors when the fusible link vaporizes in response to high current draw due to an arc fault condition. The preferred arc path includes a ground plane 160 that is electrically connected to an enclosure ground 165 with a ground bracket 163.

Figure 3:
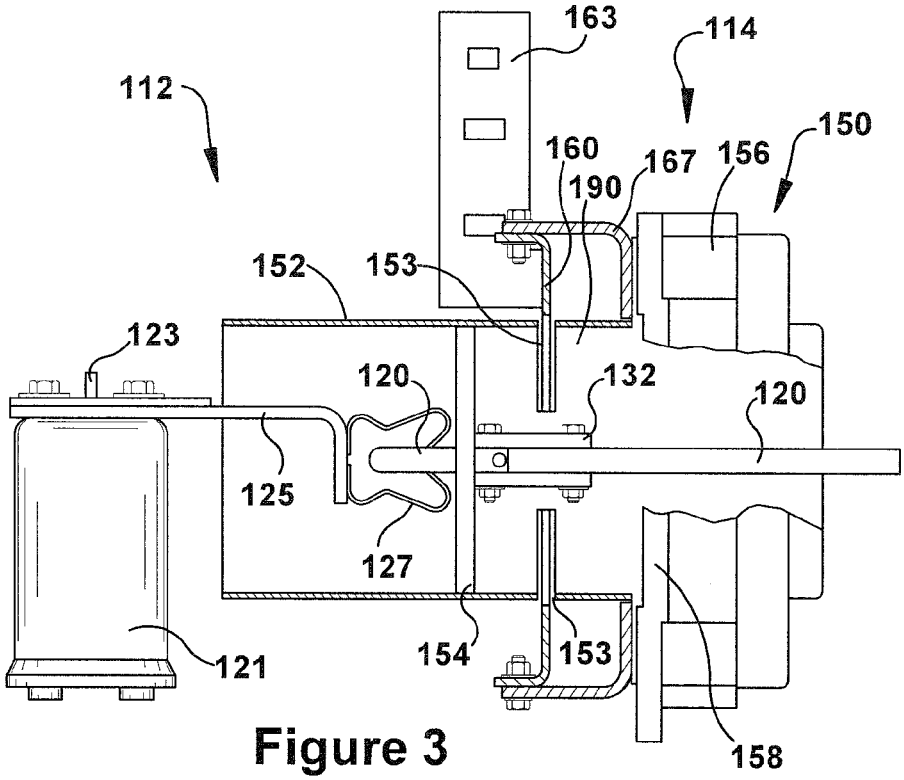
FIGS. 3 and 3*a* are cross section views of a self-pressurized arc diverter of FIG. 2.

FIG. 3 is a cross section view of a self-pressurized arc diverter 150. The self-pressurized arc diverter 150 encloses the connection of a secondary bus 125 in an auxiliary compartment 112 to a primary bus 120 in a main compartment 114. The secondary bus 125 rests on an insulator 121. The secondary bus 125 includes a connector post 123 that is used as a connection point for load related devices in the auxiliary compartment. The self-pressurized arc diverter 150 includes a slotted insulator tube 152 surrounding the connection between the primary bus 120 and the secondary bus 125. The slotted insulator tube 152 includes upper and lower slots 153 that have removable covers 155 (shown in FIGS. 2 and 4). The ground plane 160 is aligned with the slots 153 and is connected to the enclosure ground 165 (FIG. 3) by way of the ground bracket 163. A mounting flange 156 is integrally molded at one end of the insulator tube 152. A mounting bracket 167 is used to connect the mounting flange 156 to the ground plane 160 to fix their relative locations.

Figure 3A:
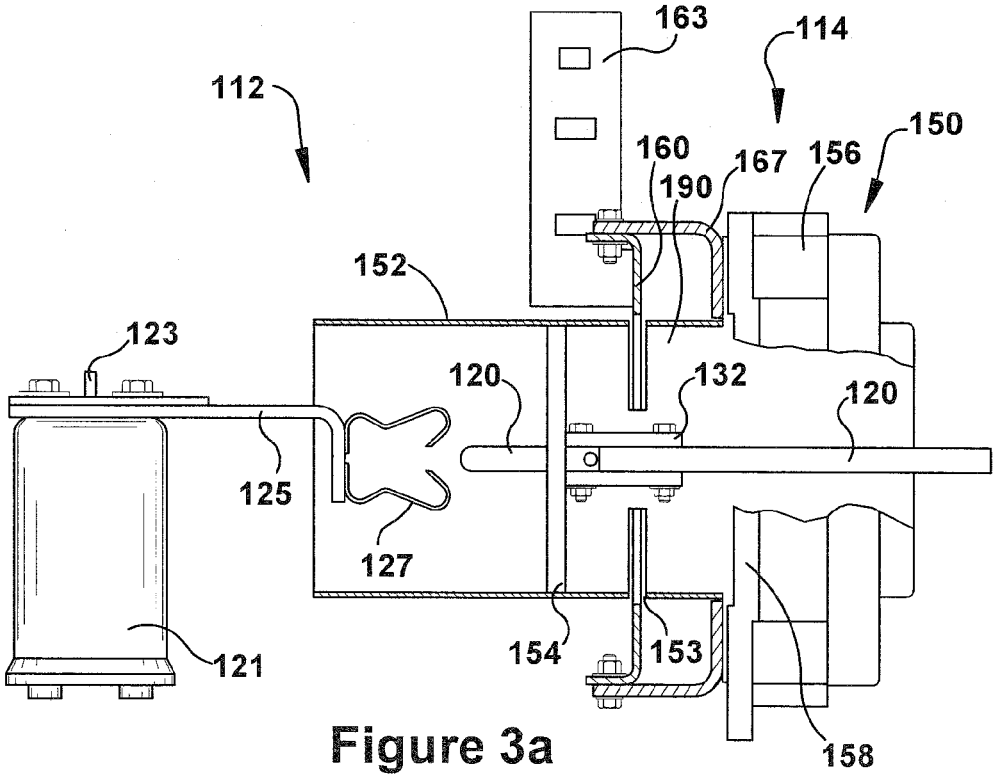

FIG. 3*a* is a cross sectional view of the self-pressurized arc diverter 150. In FIG. 3*a*, the secondary bus 125 is shown disconnected from the primary bus 120. A set of contacts 127 is connected at an end of the secondary bus 125. The contacts 127 are configured to receive an end of the primary bus 120 and to form an electrical connection between the secondary bus and the primary bus. The fusible link 132 is spliced into the primary bus 120. A seal 154 seals around the primary conductor 120 to the insulator tube 152 on the auxiliary compartment (112) side of the fusible link 132. The interior seal 158, which is molded as part of the insulator tube mounting flange 156, seals around the primary conductor 120 to the insulator tube 152 on the main compartment side (114) of the fusible link 132.

Thus, the fusible link 132 is enclosed within a vessel 190 made up of the slotted insulator tube 152 (with the cover installed) and end caps in the form of the seals 154, 158. When the fusible link 132 vaporizes, an arc will occur that creates pressure within the vessel 190. The pressure will push the cover 155 (FIGS. 2 and 4) off the slot 153. Thus, the vessel 190 may be sealed or at least be capable of building pressure sufficient to separate the cover 155 from the slot 153. When the cover 155 is removed, the slot 153 serves as an arc diverter that provides access to the ground plane 160. Accordingly, an arc fault that melts the fusible link will be diverted to the ground plane 160 as shown in FIG. 4.

Figure 4:
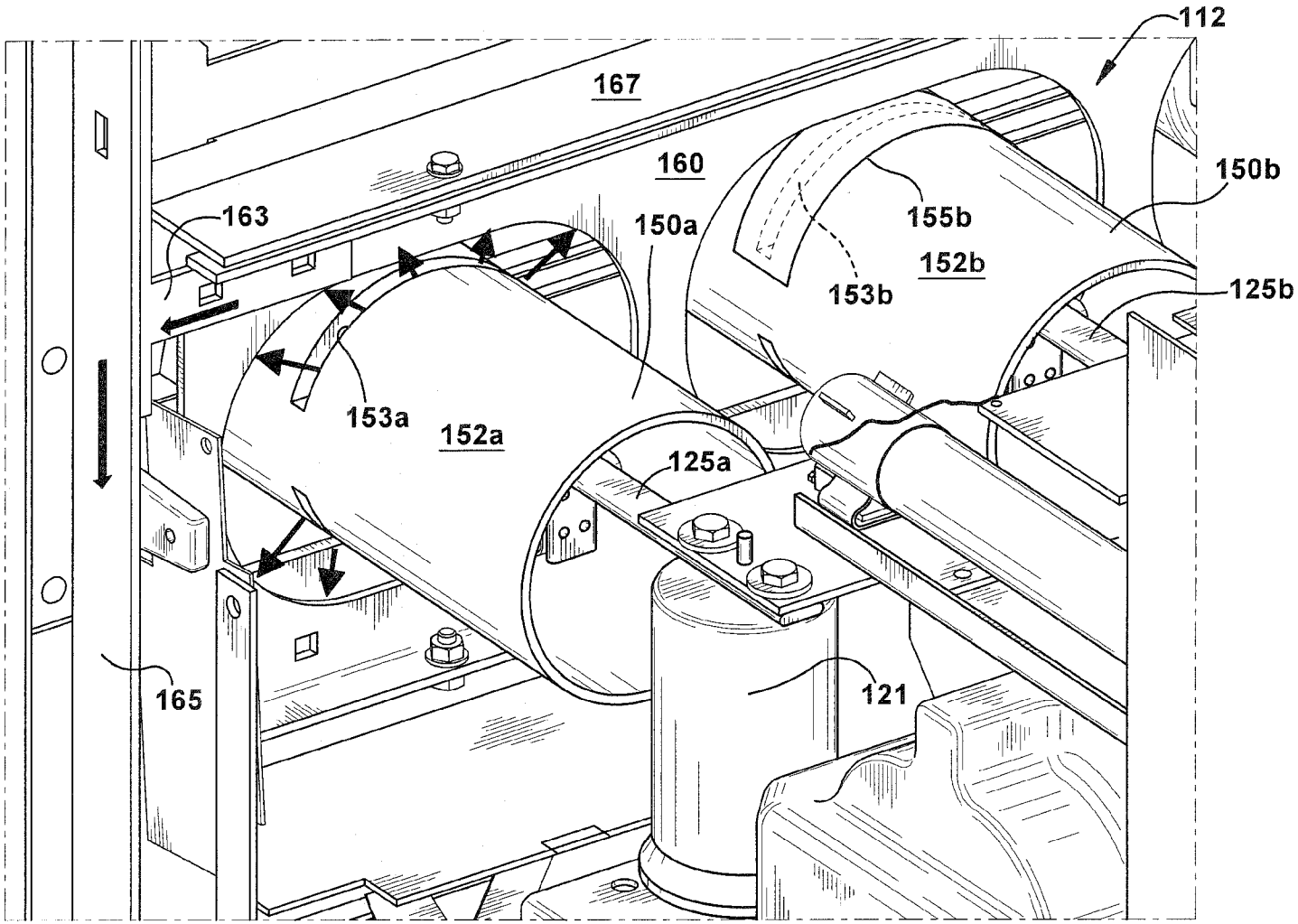
FIG. 4 is an isometric view of the self-pressurized arc diverters shown in FIG. 2.

FIG. 4 illustrates the self-pressurized arc diverter 150*a* in operation. An arc fault has occurred on the phase associated with the arc diverter 150*a* and the fusible link 132 (FIG. 3) has vaporized, creating pressure which pushed the cover 155 (not shown) off the slot 153*a*. Because no fault has occurred on the phase associated with the self-pressurized arc diverter 150*b*, the cover 155*b* still covers the slot 153*b* in the insulator tube 152*b*. Since the cover on the self-pressurized arc diverter 150*a* has been removed, the slot 153*a* provides access to the ground plane 160. The arc, shown schematically as arrows exiting the slot, travels through the slot to the preferred arc path which includes the ground plane 160, the ground bracket 163, and the enclosure ground 165.

The arc is drawn to the most proximate path to ground, which is presented by the preferred arc path made accessible by the self-pressurized arc diverter 150*a*. The preferred arc path is distantly located from the load components that are often accessed by personnel. Further, because the ground plane 160 is oriented at a 90 degree angle to the secondary bus 125, magnetic forces induced by the current will tend to shorten the arc, reducing the pressure caused by the arc and the expulsion of hot gases from the enclosure.

Figure 5:
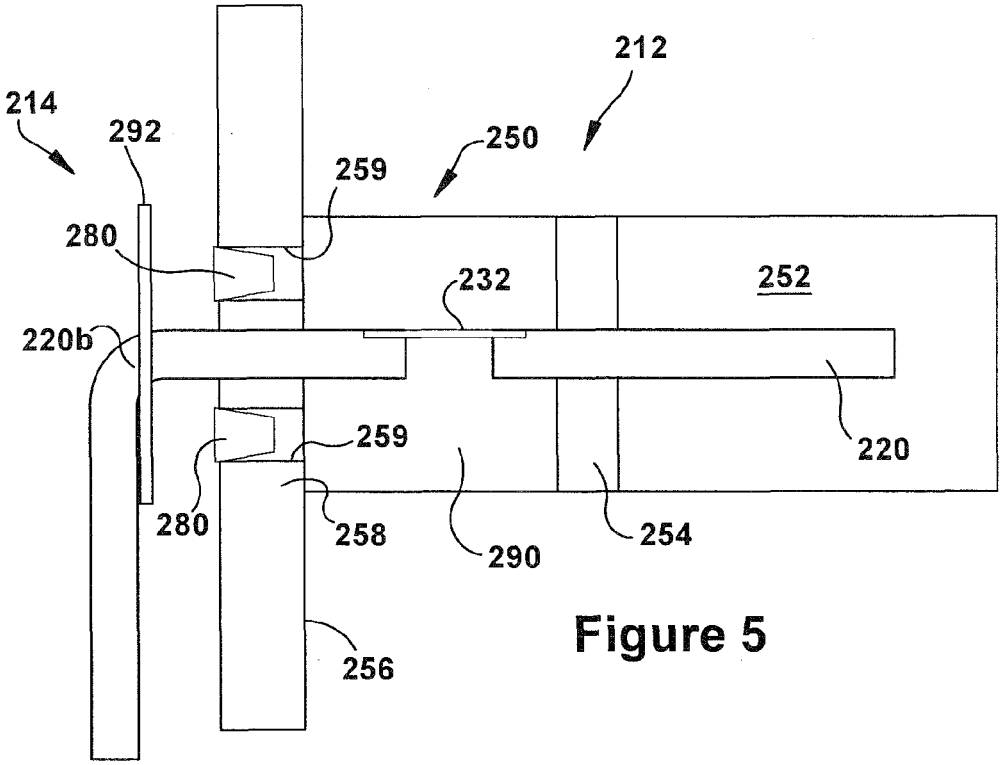
FIG. 5 is schematic side view of one example embodiment of a self-pressurized arc diverter.

FIG. 5 shows another example embodiment of a self-pressurized arc diverter 250 installed in an auxiliary compartment 212 of an electrical enclosure. The self-pressurized arc diverter 250 shown in FIG. 5 is installed on a central primary bus 220*b*. The central primary bus 220*b* supports an arc diverter plate 292 that routes an arc to adjacent phases as can be seen best in FIGS. 7 and 8. The other primary buses 220*a*, 220*c* may or may not have an arc diverter plate 292.

Figure 6:
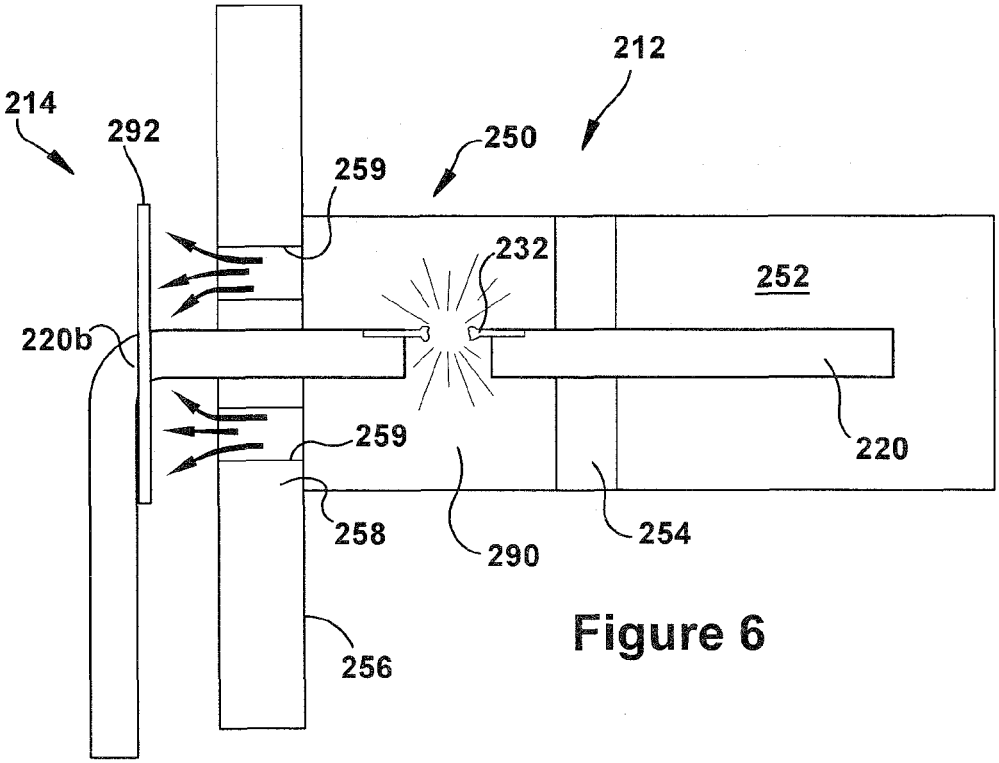
FIG. 6 is schematic side view of the self-pressurized arc diverter shown in FIG. 5.

The primary bus 220*b* includes a fusible link 232 enclosed by a vessel 290 comprised of an insulator tube 252, a seal 254, and an interior seal 258 that is part of an insulator tube mounting flange 256. The interior seal 258 includes holes 259 that serve as an arc diverter. Plugs 280 are inserted into the holes 259 and seal the holes. FIG. 6 illustrates the function of the self-pressurized arc diverter 250 when the fusible link 232 vaporizes and creates an arc. The plugs 280 (FIG. 5) have been ejected from the holes 259 by the pressure caused by the arc. The plasma jet of the arc exits the holes as shown by the arrow and strikes the arc diverter plate 292.

Figure 7:
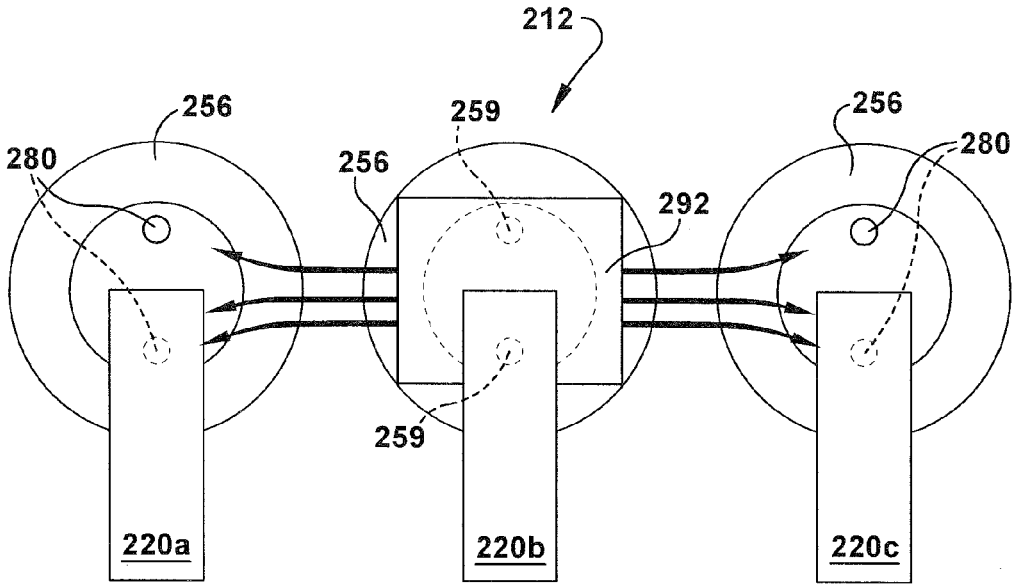
FIG. 7 is schematic rear view of the self-pressurized arc diverter shown in FIG. 5.

FIG. 7 is a view of the main compartment 212 illustrating the primary buses 220*a*, 220*b*, 220*c* and self-pressurized arc diverters. The center primary bus 220*b* includes the arc plate 292 that directs the arc to a preferred arc path which is an adjacent primary bus. A fault has occurred on primary bus 220*b* and the plugs 280 have been ejected by pressure caused by the arc. Thus the arc is diverted into the main compartment where it will short phase-to-phase, transferring the uncontrolled arc away from the auxiliary compartment. In alternate embodiments, more than one primary conductor may include an arc plate 292.

Figure 8:
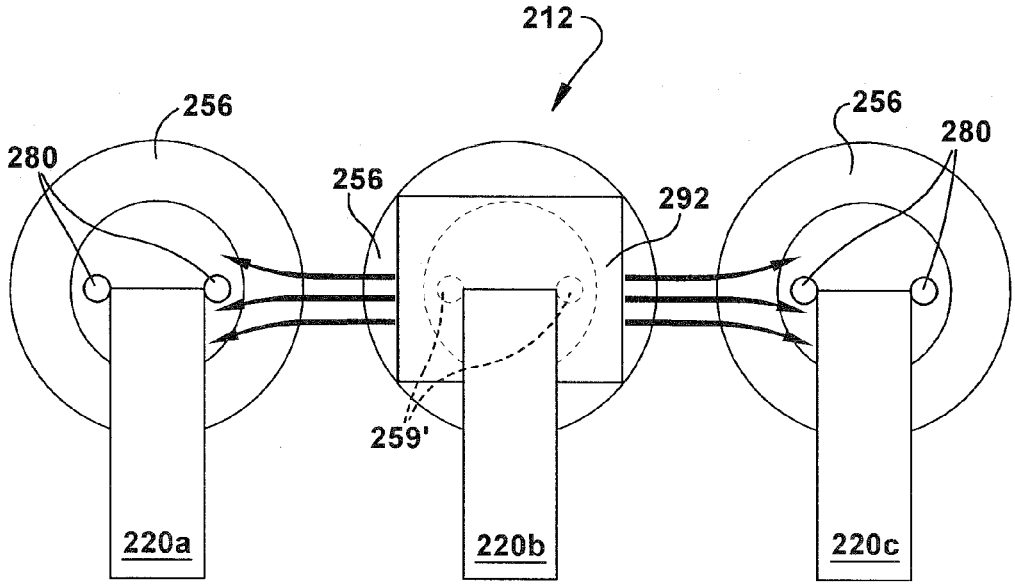
FIG. 8 is schematic rear view of another example embodiment of a self-pressurized arc diverter.

FIG. 8 is a view of the main compartment 212 illustrating the primary buses 220*a*, 220*b*, 220*c* and self-pressurized arc diverters. The self-pressurized arc diverters in FIG. 8 employ an alternate position for holes 259' and corresponding plugs 280. A fault has occurred on primary bus 220*b* and the plugs 280 have been ejected by pressure caused by the arc. The arc is thus diverted into the main compartment where it will short phase-to-phase, transferring the uncontrolled arc away from the auxiliary compartment.

While example systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Therefore, the invention is not limited to the specific details, the representative apparatus, and illustrative examples shown and described. Thus, this application is intended to embrace alterations, modifications, and variations that fall within the scope of the appended claims.

To the extent that the term "includes" or "including" is employed in the detailed description or the claims, it is intended to be inclusive in a manner similar to the term "comprising" as that term is interpreted when employed as a transitional word in a claim.

What is claimed is:

1. An arc resistant apparatus for diverting an uncontrolled arc fault, said arc resistant apparatus comprising: a vessel configured to enclose a fusible member spliced into a conductor; and a pressure-activated arc diverter configured to divert the uncontrolled arc fault and provide access to a preferred conductive arc path when actuated by pressure in the vessel caused by an arc that is created when the fusible member opens.

2. The apparatus of claim 1 where the vessel comprises a cylindrical insulator tube having end caps through which the conductor passes.

3. An apparatus comprising: a vessel configured to enclose a fusible member spliced into a conductor; and a pressure-activated arc diverter configured to provide access to a preferred conductive arc path when actuated by pressure in the vessel caused by an arc that is created when the fusible member opens;

where the vessel comprises a cylindrical insulator tube having end caps through which the conductor passes, where the arc diverter comprises at least one slot in the cylindrical insulator tube and an insulating cover on the slot, where the cover is configured to be dislodged from the slot when the insulator tube becomes pressurized by the arc.

4. The apparatus of claim 2 where the arc diverter comprises one or more plugs inserted into holes in one of the end caps, where the one or more plugs are configured to be dislodged from the one of the end caps when the insulator tube becomes pressurized by the arc.

5. The apparatus of claim 1 where the preferred conductive arc path comprises a ground plane.

6. The apparatus of claim 1 where the preferred conductive arc path comprises a conducting plate that routes an arc to an adjacent phase conductor.

7. The apparatus of claim 1 where the conductor is located within a main electrical enclosure and the preferred conductive arc path is located within the main electrical enclosure.

8. The apparatus of claim 1 where the preferred conductive arc path is oriented perpendicular to a flow of current through the conductor to shorten a length of the arc to minimize an amount of pressure created by the arc.

9. The apparatus of claim 1 where: the vessel comprises means to enclose the fusible member spliced into the conductor; and the pressure-activated arc diverter comprises means to provide access to the preferred conductive arc path when actuated by pressure in the vessel caused by the arc that is created when the fusible member opens.

10. An arc resistant bus assembly for diverting an uncontrolled arc fault, said arc resistant bus assembly comprising: a bus; a preferred arc path component disposed proximate to the bus that provides a conductive ground path; a fusible link spliced into the bus, the fusible link configured to conduct a rated current of the bus and to vaporize in response to current above the rated current; a vessel enclosing the fusible link; and pressure-activated arc diverter configured to divert the uncontrolled arc fault and provide access to a preferred conductive arc path when actuated by pressure in the vessel caused by an arc that is created when the fusible link opens.

11. The bus assembly of claim 10 where the vessel comprises a cylindrical insulator tube having end caps through which the conductor passes.

12. A bus assembly comprising: a bus; a preferred arc path component disposed proximate to the bus that provides a conductive ground path; a fusible link spliced into the bus, the fusible link configured to conduct a rated current of the bus and to vaporize in response to current above the rated current; a vessel enclosing the fusible link; and pressure-activated arc diverter configured to provide access to a preferred arc path when actuated by pressure in the vessel caused by an arc that is created when the fusible link opens, where the vessel comprises a cylindrical insulator tube having end caps through which the conductor passes, where the arc diverter comprises at least one slot in the insulator tube and an insulating cover on the slot, where the cover is configured to be dislodged from the slot when the insulator tube becomes pressurized by the arc.

13. The bus assembly of claim 11 where the arc diverter comprises one or more plugs inserted into holes in one of the end caps, where the one or more plugs are configured to be dislodged from the one of the end caps when the insulator tube becomes pressurized by the arc.

14. The bus assembly of claim 10 where the preferred arc path component comprises a ground plane.

15. The bus assembly of claim 10 where the preferred arc path component comprises a conducting plate that routes an arc to an adjacent phase conductor.

16. The bus assembly of claim 10 where the preferred arc path component is oriented perpendicular to a flow of current through the conductor to shorten a length of the arc to minimize an amount of pressure created by the arc.

* * * * *